US005211227A

United States Patent [19]

Anderson

[11] Patent Number: 5,211,227

[45] Date of Patent: May 18, 1993

[54] FUGITIVE EMISSIONS ACCUMULATOR

[76] Inventor: L. F. Anderson, 110 Salida Pl., Tulare, Calif. 93274

[21] Appl. No.: 789,661

[22] Filed: Nov. 8, 1991

[51] Int. Cl.[5] ..... B21B 33/03

[52] U.S. Cl. ..... 166/84; 166/81

[58] Field of Search ..... 166/81, 82, 84, 88; 277/19, 20

[56] References Cited

U.S. PATENT DOCUMENTS 4,321,975 3/1982 Dyer ..... 175/206

4,530,397 7/1985 Calhoun ..... 166/84

*Primary Examiner*—William P. Neuder

*Attorney, Agent, or Firm*—Dennis B. Haase

[57] ABSTRACT

A fugitive emmissions accumulator having particular, although not exclusive, use in capturing fugitive oil at a wellhead, wherein an accumulator vessel is sealingly mounted to the wellhead about the polish rod, and wiper means disposed in the accumulator vessel to remove fugitive oil from the polish rod, and wherein the wiper means is floatable relative to the vessel so as to maintain wiping contact with the polish rod at all times, including vertical misalignment thereof.

12 Claims, 3 Drawing Sheets

P
C
L
R
10
98
S
Q
W
B 36
57
R
53
63
10
38
40
14
70
102
59
61
98
16
21
18
95
96
12
S

R
76
38
57
55
53
59
67
102
90
65
88
36
40
10
63
61
70
74
92
80
46
21
84
72
42
44
18
48
32
49
95
14
11
30
31
12
23
25
27
S

FUGITIVE EMISSIONS ACCUMULATOR

The present invention relates to devices for capturing and accumulating fugitive emissions having principal, although not exclusive, utility with respect to entrapment of petroleum products escaping along the polish rod at the stuffing box of an oil well.

BACKGROUND OF THE INVENTION

Field of the Invention

Throughout the world, oil producing countries face a common problem which is indigenous to the removal of petroleum products from subsurface deposits. That problem asserts itself in the form of leaky stuffing boxes which result in petroleum spills in the area immediately surrounding the wellhead.

Most, if not all, subsurface wells have certain common elements, among them, a sucker rod, or, indeed, a string of sucker rods, ascending from a polish rod of a pumping apparatus, whether it be walking beam or of the long stroke variety, into the well. A pump, which may take various forms, is disposed at the end of the string, which is in the petroleum deposit. At the wellhead, just above ground level, is a stuffing box through which the polish rod passes.

The stuffing box does precisely what its name suggests, i.e., it holds a packing which is intended to wipe the polish rod free of fugitive petroleum which typically adheres to the polish rod as it moves in and out of the well.

There are several, widely recognized, problems with stuffing boxes, however, which remain relatively constant despite numerous efforts to cure them. Specifically, the packing, or stuffing, tends to wear as the polish rod reciprocates. Because of the inherent need for the stuffing of packing to be flexible, there is a tendency for it to take a set, and even experience some shrinkage due to temperature changes, and under conditions where the well remains dormant for a period of time.

Finally, a problem inherent in pump design and construction, is a misalignment of the polish to sucker rod, string, or even slight bends or waves in the string, either one or both of which results in a slight, but universally devastating lateral movement of the sucker rod at the stuffing box which results in leakage of petroleum crude out of the top of the stuffing box and onto the adjacent land.

Virtually since pumping of subsurface wells began, a little petroleum on the ground around a stuffing box was of no particular concern. The stuffing or packing was periodically changed, but if the frequency of change was insufficient to prevent spills, no one seemed to care.

With growing environmental concerns came governmental organizations such as the Environmental Protection Agency. The growth and expansion of that agency's overview of petroleum production was spawned, in part, by a concern for petroleum spillage around well heads, and with it tightened restrictions, complete with significant fines for violations, for failure to hold such leakage in check. Accordingly, an objective of the present invention is to provide oil producers with a device which is capable of catching and accumulating such fugitive petroleum spillage, so as to permit inexpensive, yet efficient compliance with applicable EPA standards, while at the same time effectively eliminating losses due to spillage.

Another objective of the present invention, of course, is to provide apparatus which is capable of adapting to and overcoming stuffing box problems, including, but not limited to, misalignment, and/or curvature in the polish rod.

Overview of the Prior Art

The present invention is certainly not the first, although it is the most efficient, effort to address the problems with stuffing boxes enumerated hereinabove. The most common, and coincidentally least successful approach, has been to build a "super" stuffing box to put on top of the existing stuffing box at the wellhead. Gordon U.S. Pat. No. 4,872,508, Calhoun U.S. Pat. No. 4,530,397 and Rutherford U.S. Pat. No. 4,665,976 comprise variations on this same theme. All of these patented devices rewipe, or super wipe, the polish rod and accumulate the oil which is wiped therefrom. All of these devices include packings which wear, and none of them address adequately the reason why the packings wear. Thus, service intervals for such devices tend to parallel service intervals for stuffing boxes and there is little, if any, saving to the producer, who faces the same leakage problems with these devices that he faced with the stuffing box without such a device added.

SUMMARY OF THE INVENTION

In addition to other objectives recited, it is a paramount objective of the present invention to provide a device which acclimates to conditions at the stuffing box, whatever they may be, so as to catch and accumulate fugitive petroleum emissions from the stuffing box which can then be returned to storage, thereby minimizing, if not eliminating, spill cleanups, and hazardous waste storage costs, which lead to regulatory fines, while at the same time, minimizing well down time for maintenance and repair of the stuffing box which leads, inevitably, to lost production.

The foregoing objectives established for the present invention are accomplished by the provision of an accumulator which seats, in sealing relation, or the top of the stuffing box where the sucker rod string passes to the pumping unit, and which further provides for the wiping of the sucker rod to remove accumulated petroleum thereon, which wiping apparatus is capable of acclimating to misalignment and curvature in the sucker rod string.

DESCRIPTION OFT HE DRAWING

With the foregoing firmly in mind, a preferred embodiment of the present invention will be described in connection with the accompanying drawings, wherein FIG. 1 illustrates the environment at the wellhead with a typical walking beam pumping apparatus illustrated;

DESCRIPTION OF THE PREFERRED EMBODIMENT

Figure 1:
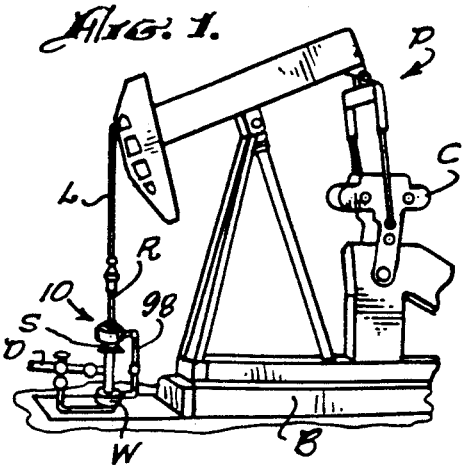

With reference now to the drawings, and initially to FIG. 1, a pumping unit P, of the walking beam type is illustrated, disposed on a base B above a wellhead W, above which a stuffing box S is mounted in sealing relation. A polish rod R is connected to the pumping unit P by means of line L. The polish rod connects to a sucker rod string disposed in the well and at the end of which is a pumping element (not illustrated) which serves to draw oil to the surface and into a distributor manifold D, which is typically piped directly to a tank farm, or in some instances, directly to the refinery.

Teeter totter movement of the walking beam is accomplished by means of rotating counterweights C, which imparts reciprocal movement to the polish rod, and thus, the string of sucker rods.

Having thus established the environment within which the present invention has particular utility, a fugitive emission accumulator 10 is shown, in its operative position, seated atop, and in sealing relationship with, a stuffing box S.

Figure 3:
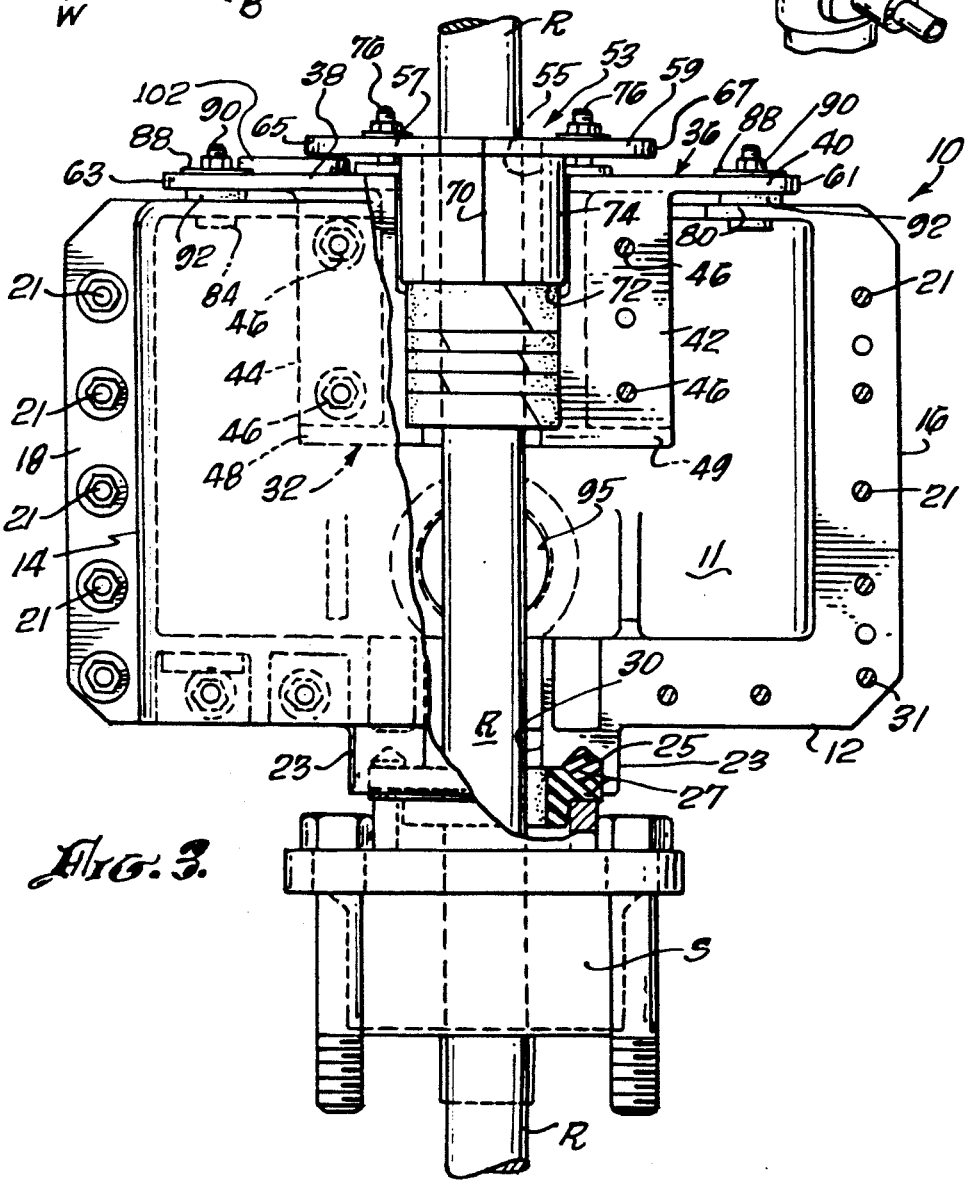
FIG. 3 is an enlarged elevation of the accumulator of the present invention, partially sectioned to show certain details thereof.

Moving to FIG. 3, the accumulator 10, in accordance with the present invention, includes a reservoir 11, defined by outer casing halves 12 and 14, respectively. Each of the outer casing halves 12 and 14 are formed with vertical flanges 16 and 18, respectively, which, in their operative position, are bolted, or otherwise affixed together, about the polish rod, by fasteners 21.

Each of the casing halves are formed with a vertically depending boss 23, which is grooved as at 25 to receive seals or packing assembly 27, which is intended to seal the assembled casing sections 12 and 14 against the stuffing box S.

The boss has a centrally disposed bore 30, through which passes the polish rod R in the assembly shown in FIG. 3.

As previously discussed, materials in the stuffing box tend to wear as the polish rod R reciprocates. Accordingly, experience has demonstrated that some petroleum crude will adhere to the polish rod as it reciprocates through and above the stuffing box S. It should be remembered that the stroke of the polish rod can range from as much as 32 feet in a deep well to just a few feet in a shallow well. Accordingly, a considerable portion of the polish rod moves beneath the stuffing box and into the well proper on its down stroke, and considerably above the stuffing box in its retracted position.

In order, in accordance with the invention, to capture and accumulate such fugitive emissions, a wiper assembly 32 is provided within the reservoir defined by the outer casing halves 12 and 14.

Figure 5:
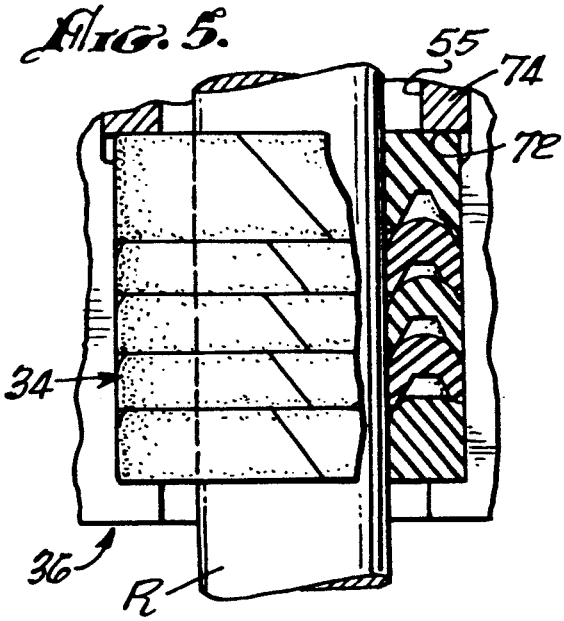
FIG. 5 is a partial sectional view of the wiping apparatus illustrated in partial section in FIG. 3.
Figure 6:
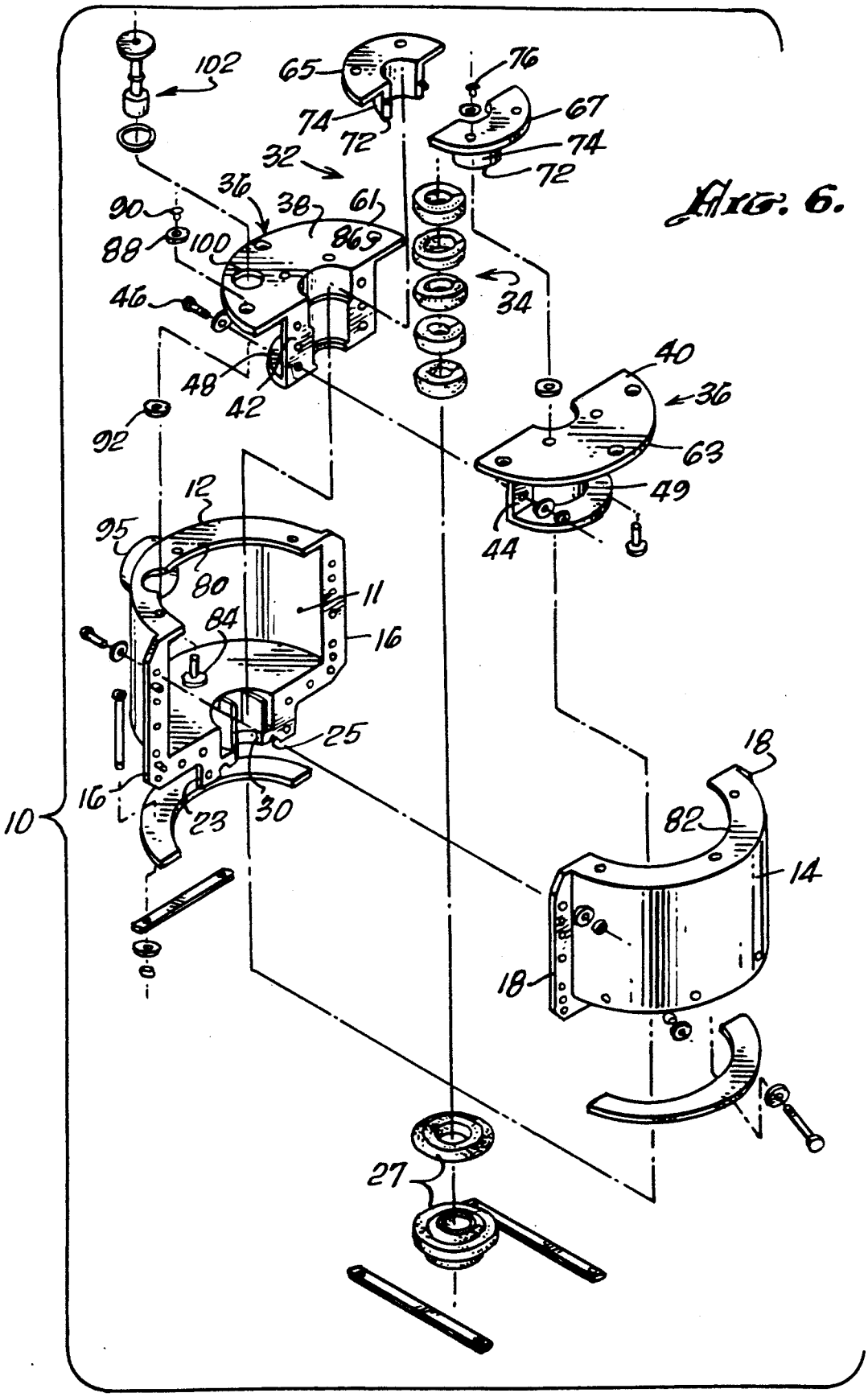
FIG. 6 is an exploded perspective of the accumulator of the present invention.

The wiper assembly includes a series of split ring flexible wiper elements 34 of a known inverted "V" shaped construction, as seen in FIG. 5. In the present instance, five such rings are shown in their mounted position about the polish rod R. The wiper elements are positioned about the polish rod in a receptacle 36 defined by a pair of opposed cup halves, best seen in FIG. 6, 36 and 40, respectively. Each such half is formed with opposed vertical flange elements 42 and 44, respectively, which are secured together by means of a fastener 46. In order to provide strength, each of the halves 38 and 40 are also provided with a bottom transverse flange 48 and 49, respectively.

As seen in FIG. 3, the wiper elements 34 nest with each other in the receptacle 36 formed by the assembled cup halves 38 and 40, respectively.

In order to inhibit movement of the wiper elements with the reciprocating polish rod R, a cap 53 is provided, having a bore 55 through which the polish rod extends. Once again, in order to facilitate assembly of the accumulator about the polish rod with a minimum of down time, the cap 53 is split into cap halves 57 and 59, respectively.

The wiper assembly 32, defined by cup halves 38 and 40, has an upper, mounting flange 61 and 63, respectively, on the halves 38 and 40. The mounting flanges 61 and 63 are transverse to the axis of movement of the polish rod.

In order to secure the cap in place, cap halves 57 and 59 are provided with transverse, essentially horizontal flange sections 65 and 67, respectively. As will be seen in FIG. 3, when the cap halves are inserted into the receptacle defined in the wiper assembly, a tight, essentially vertical seam is formed at 70, and because the cap is dimensioned to fit tightly into the receptacle, an oil impervious seal is formed. Moreover, it will be seen that the lower terminus 72 of the cap presses against the split ring wiper elements, holding them securely in place in their position about the polish rod.

Further in accordance with the invention, by dimensioning the cap such that its cylindrical body 74 will apply pressure to the stack of split ring wiper elements, the wiper elements tend to bulge along their transverse axes, thereby enhancing the wiping action between the polish rod and the wiper elements. The amount of pressure to be applied can be varied within limits by the amount of draw down on the fasteners 76, which secure the cap to the flange halves 61 and 63, respectively, of the wiper assembly. The cap, of course, is readily removable for maintenance and replacement of the wiper rings, a task which is easily accomplished by virtue of the construction of the accumulator of the present invention.

As previously mentioned, the alignment of the polish rod relative to the wellhead W is often less than perfectly vertical. Moreover, the polish rod and attached sucker rods, which form the string, comprise a plurality of sections of rod which may be screwed, and in some instances, welded together. The length of the string may be several thousand feet, or only a few feet, but it is common for the string to be not totally straight. Accordingly, as the polish rod reciprocates through the stuffing box, a wobble, or movement of the polish rod in a transverse plane to the vertical axis thereof, is experienced. This transverse wobble is a cause of breakdowns in the stuffing box which result in greatly accelerated bypass of petroleum crude.

The present invention, recognizing this significant problem experienced in the field, provides means for acclimating the accumulator to the situation, virtually eliminating the adverse consequences of polish rod wobble.

Figure 4:
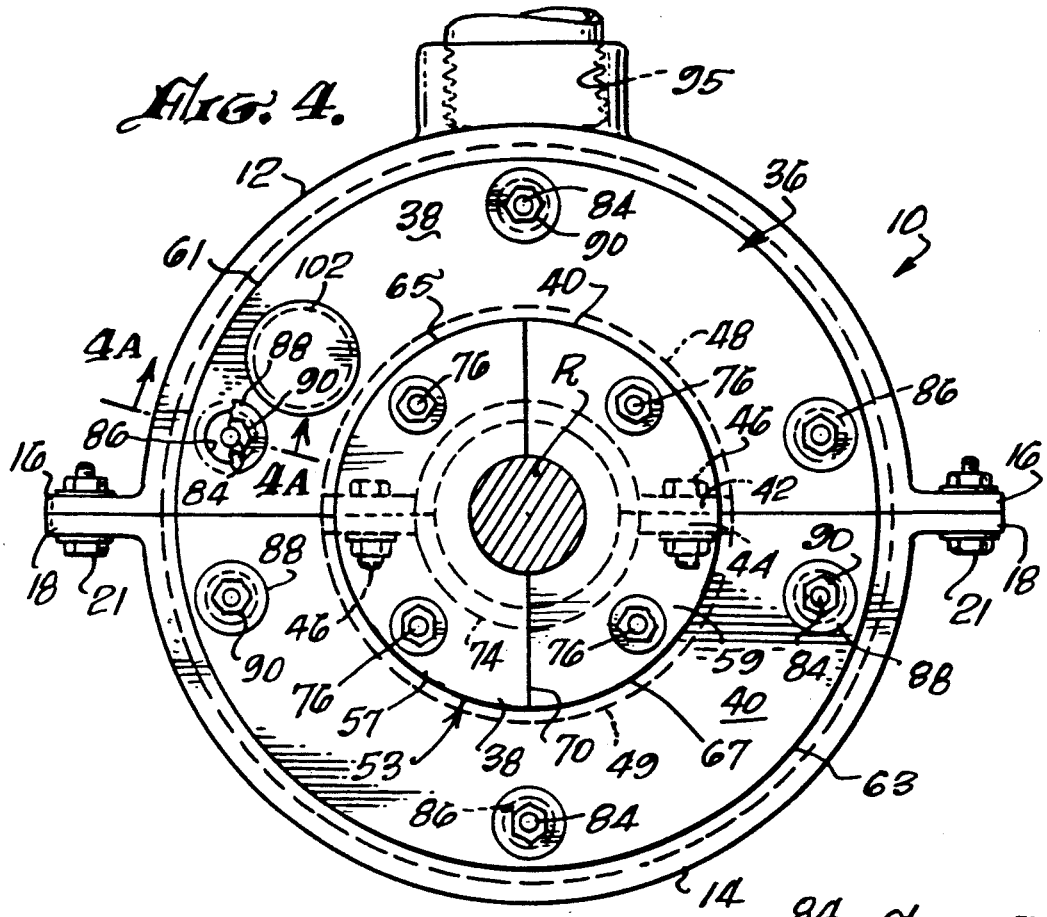
FIG. 4 is a top plan view of the accumulator of the present invention.
Figure 4A:
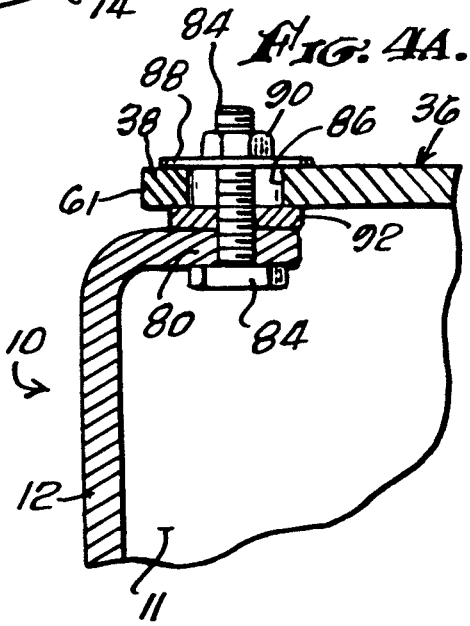
FIG. 4A is a partial sectional view taken along line 4A—4A of FIG. 4.

In keeping with this aspect of the invention, and with reference to FIGS. 4 and 4A, respectively, means is provided for limited transverse movement of the wiper assembly within the accumulator as the polish rod reciprocates. Specifically, the outer casing halves are provided with an inwardly turned mounting surface, or shelves, 80 and 82, respectively. Fasteners 84 are disposed in a circular array about the mounting surface in openings 85. Coincident with the provision of the fasteners, the upper transverse mounting flanges 61 and 63 respectively, of the cup assembly are formed with a series of openings 86, again in a circular array such that they align precisely with the fasteners 84.

In order, however, to permit the wiper assembly to move laterally and transverse to the reciprocating movement of the polish rod, the openings 86 are of a diameter which is larger than the diameter of the shank of fastener 84 which passes through such openings. By using a flat washer 88 beneath the nut 90 of the fastener 84, and a seal 92 between the mounting flange 61 and the inturned mounting surface 80, a fluid seal is accomplished while at the same time permitting limited lateral movement of the mounting flange 61 relative to the casing halves of the accumulator. It will be appreciated that openings 85 may be made larger than openings 86 without departure from the invention.

Figure 2:
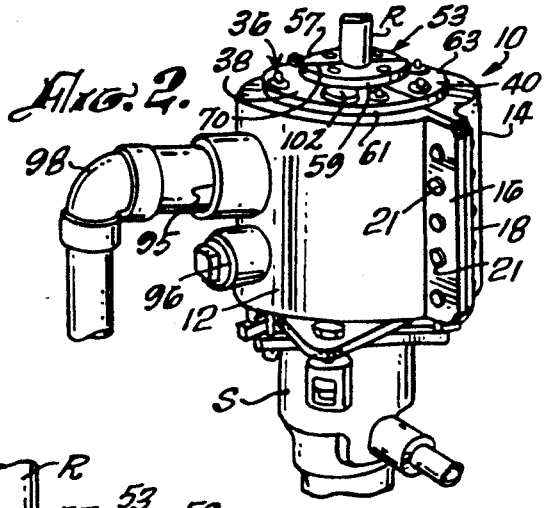
FIG. 2 is a pictorial view of the fugitive emissions accumulator of the present invention, in position on the wellhead.

With reference to FIG. 2, one of the casing halves, in this instance, 14, is provided with drawing orifices 95 and 96, respectively, which may be hooked into a fluid line 98 to drain fluid accumulated in the reservoir at the level at which the drain orifice is located. Finally, an opening 100 is provided in the mounting flange of the cup, into which an electronic sensing element 102 may be placed to signal malfunction of the accumulator should such an unlikely event occur.

In summary, the foregoing describes, in detail, a novel accumulator for capturing and accumulating fugitive emissions at a well site. By virtue of the ability of the accumulator to compensate for sucker rod wobble and packing wear, by capturing fugitive emissions which would otherwise be pumped out of the stuffing box onto the ground, well down time and maintenance is minimized, since even if, through wear, the packing becomes worn, the emissions resulting from such wear, together with sucker rod wobble, are captured and not spilled. Therefore, the operator can extend maintenance intervals significantly. It will be apparent, however, to those skilled in the art, that there are some variations and modifications to the specific structure described which could be made without departing from the inventive concepts disclosed herein. The invention, therefore, is not to be restricted to the precise structure described, except as it may be set forth in the appended claims, wherein:

I claim:

1. In a fugitive emission accumulator for use in collecting blow by at a wellhead, of the type having a stuffing box with a polish rod protruding from the top of the stuffing box and being reciprocable along an essentially vertical axis therethrough, comprising, in combination:

a fluid accumulator vessel, said vessel disposed immediatly above, and in sealing relationship with the stuffing box; means defining an opening through said vessel, said opening adapted to surround the polish rod so as to permit reciprocal movement of the polish rod through said vessel;

wiper means disposed about the polish rod within said vessel, said wiper means being in contact with said polish rod so as to wipe accumulated fluid collected on the surface of the polish rod as it reciprocates into and out of the stuffing box;

said wiper means being mounted in said vessel, and being floatable with respect thereto so as to maintain wiping contact with the polish rod at all times, including times of axial misalignment, whereby fluid accumulation on the polish rod is wiped off and deposited in said vessel, thereby inhibiting escape thereof to the atmosphere.

2. A fugitive emission accumulator as described in claim 1, wherein means defining a wiper housing is provided, said wiper housing having a cupped receptacle therein for receiving and positioning said wiper means in wiping contact with the polish rod; said housing having a flange disposed about its pheriphery, said flange extending outwardly from said cup in a plane which is generally transverse to the axis of the reciprocating sucker rod; and means for interconnecting said flange and said vessel to permit limited lateral movement of said wiper housing relative to said vessel.

3. A fugitive emissions accumulator as described in claim 1, wherein means is provided for evacuating fluid from said fluid accumulator vessel when the fluid therein reaches a predetermined level.

4. A fugitive emissions accumulator as described in claim 1, wherein means defining a cap, said cap being removably secured to said wiper housing to close said receptacle, and in sealing contact with said wiper to secure said wiper in said cup.

5. A fugitive emissions accumulator as described in claim 2 wherein said cap is removably secured to said wiper housing for ready replacement of said wiper, and said cap defining a chamber, said chamber being disposed about the polish rod for accumulation of any fluids which might inadvertently bypass said wiper means.

6. A fugitive emissions accumulator as described in claim 4, wherein said cap is adapted to press against said wiper means when secured to said wiper housing, causing said wiper means to expand against the polish rod.

7. A fugitive emissions accumulator as described in claim 2, wherein said accumulator vessel is provided with amounting shelf;

said flange on said wiper cup is adapted to overlap said mounting shelf; said mounting shelf and said flange having aligned openings therein;

fasteners disposed in said openings to connect said wiper cup and accumulator vessel; said openings in said flange being greater in size than said openings in said shelf such that said wiper cup floats relative to said accumulator vessel while remaining in wiping contact with the polish rod.

8. A fugitive emissions accumulator as described in claim 1, wherein means is provided in said accumulator vessel for detecting fluid level therein; and discharge means connected to said accumulator vessel; said discharge means responsive to said fluid detection means for releasing fluid from said accumulator vessel.

9. A fugitive emissions accumulator as described in claim 2, wherein means is provided in said accumulator vessel for detecting fluid level therein; and discharge means connected to said accumulator vessel; said discharge means responsive to said fluid detection means for releasing fluid from said accumulator vessel.

10. A fugitive emissions accumulator as described in claim 7, wherein means is provided in said accumulator vessel for detecting fluid level therein; and discharge means connected to said accumulator vessel; said discharge means responsive to said fluid detection means for releasing fluid from said accumulator vessel.

11. A fugitive emissions accumulator as described in claim 2, wherein said cap is adapted to press against said wiper means when secured to said wiper housing, causing wiper means to expand against the polish rod.

12. A fugitive emissions accumulator as described in claim 5, wherein said cap is removably secured to said wiper housing for ready replacement of said wiper, and said cap defining a chamber, said chamber being disposed about the polish rod for accumulation of any fluids which might inadvertently bypass said wiper means.

* * * * *